US010984763B1

(12) United States Patent
Schoonraad et al.

(10) Patent No.: US 10,984,763 B1
(45) Date of Patent: Apr. 20, 2021

(54) STRINGED INSTRUMENT MACHINE HEAD ADAPTER

(71) Applicant: AMP Devices, LLC, North Hollywood, CA (US)

(72) Inventors: Robert Andrew Schoonraad, North Hollywood, CA (US); Ronald Girgis, North Hollywood, CA (US)

(73) Assignee: AMP Devices, LLC, North Hollywood, CA (US)

( * ) Notice: Subject to any disclaimer, the term of this patent is extended or adjusted under 35 U.S.C. 154(b) by 0 days.

(21) Appl. No.: 16/943,775

(22) Filed: Jul. 30, 2020

(51) Int. Cl.
*G10D 3/14* (2020.01)

(52) U.S. Cl.
CPC ..... *G10D 3/14* (2013.01)

(58) Field of Classification Search
CPC ..... G10D 3/14; G10D 3/12; G10D 3/147
See application file for complete search history.

(56) References Cited

U.S. PATENT DOCUMENTS

2002/0148342 A1* 10/2002 Kang ..... G10D 3/14 84/304

* cited by examiner

*Primary Examiner* — Kimberly R Lockett
(74) *Attorney, Agent, or Firm* — Ansari Katiraei LLP; Arman Katiraei; Sadiq Ansari

(57) ABSTRACT

Provided is a machine head adapter for mounting a machine head, that is misaligned with an existing mounting hole on an instrument, to the instrument. The adapter may include a solid rigid body with a base section of a first thickness, a mounting point extending the base section, a support extension of a second thickness, and a set screw. The support extension extends laterally from an upper part of the base section such that a bottom of the support extension is elevated over a bottom of the base section by a difference between the first thickness and the second thickness. The set screw is positioned about a length of the support extension, and adjustably extends below the bottom of the support extension to the bottom of the base section. The adapter includes a screw for screwing into the existing mounting hole via an opening at the mounting point.

14 Claims, 11 Drawing Sheets

STRINGED INSTRUMENT MACHINE HEAD ADAPTER

BACKGROUND

Guitars and other stringed musical instruments may have machine heads (also referred to as tuners, tuning machines, tuning keys, tuning pegs, etc.). Each machine head may be used to adjust the tension for a different string of the instrument, thereby adjusting the pitch and/or sound characteristics produced by that string during play.

A machine head may include a winding post, pinion gear, worm drive, adjustment knob, housing, and/or mounting base. The machine head may be secured to the headstock or other part of an instrument by inserting the winding post through a bore hole in the instrument, and by driving screws through one or more screw holes in the mounting base into aligned mounting holes on the instrument. The machine head winding post may include a hole into which a string is inserted and secured to the winding post. The winding post may be attached to the pinion gear. The adjustment knob may extend from the worm drive, and the worm drive may be connected to the pinion gear. When a musician turns the knob, the worm drive turns the pinion gear which spools or unspools the guitar string to increase or decrease string tension.

Musicians may replace the machine heads on their instruments for various reasons. For instance, a machine head may be damaged and unable to hold tension over time, or the musician may prefer the action of a different machine head.

Different machine head manufacturers may create machine heads that have different mounting bases or different placements for the mounting base screw holes. As a result, different machine heads may mount to the instrument using different screw positions. In other words, the mounting base screw holes of different machine heads may not align with existing mounting holes of an instrument.

FIG. 1 illustrates different machine heads 110, 120, 130, and 140 that have different mounting bases and/or different positioning for the mounting base screw holes. For instance, machine head 110 has a circular housing with a mounting base and single screw hole 115 extending at a 180-degree angle directly through the center axis of the gear housing. Machine head 120 has a circular housing with a mounting base and single screw hole 125 extending at a 225-degree angle from the housing. Machine head 130 has a U-shaped housing with a mounting base and single screw hole 135 extending at a 270-degree angle from the housing. Machine head 140 has a circular housing with a mounting base and single screw hole 140 extending at approximately a 190-degree angle from the housing. None of machine heads 120, 130, and 140 can be used as a direct replacement for machine head 110 and vice versa.

Accordingly, to replace a machine head, the musician may have to create new mounting holes in the headstock in order to mount machine heads with different mounting bases and/or different screw hole configurations. Older or existing mounting holes of the headstock, that were used to mount a previous set of machine heads, may be left exposed.

Such alterations to the headstock may deface the appearance of the instrument, devalue the instrument, damage the instrument, and/or alter sound characteristics. Accordingly, musicians may avoid changing the machine heads if the preferred machine heads require modification to the headstock.

DETAILED DESCRIPTION OF PREFERRED EMBODIMENTS

The following detailed description refers to the accompanying drawings. The same reference numbers in different drawings may identify the same or similar elements.

Disclosed are one or more machine head adapters. Each machine head adapter may be used to mount replacement machine heads with different mounting bases and/or different placements of the mounting base screw holes that do not align with existing mounting holes on an instrument, without altering the instrument and/or creating new mounting holes to accommodate the different mounting bases and/or different placements for the screw holes.

The machine head adapter may provide a base section with one or more mounting points that are aligned with and that are used to mount to the instrument using one or more existing mounting holes of the instrument. The machine head adapter may also provide a support extension that extends from the base section to directly abut and retain the position of the machine head housing, and that further extends over the machine head mounting base with one or more set screws that are aligned with and can be secured to one or more screw holes within the mounting base. The support extension and the one or more set screws may lock the position of the machine head once the machine head adapter is secured to the one or more existing mounting holes.

A musician may use the machine head adapters disclosed herein to replace the machine heads of a stringed musical instrument (e.g., guitar, bass, etc.) with machine heads from different manufacturers that have different housing shapes, mounting base shapes, and/or screw hole patterns or positioning. In particular, the musician may use the machine head adapters to replace the instrument machine heads without defacing the instrument, devaluing the instrument, damaging the instrument, and/or altering the sound characteristics, and with minimal time and effort as the machine head adapters eliminate the need for carefully measuring and drilling new mounting holes into the instrument.

Figure 1:
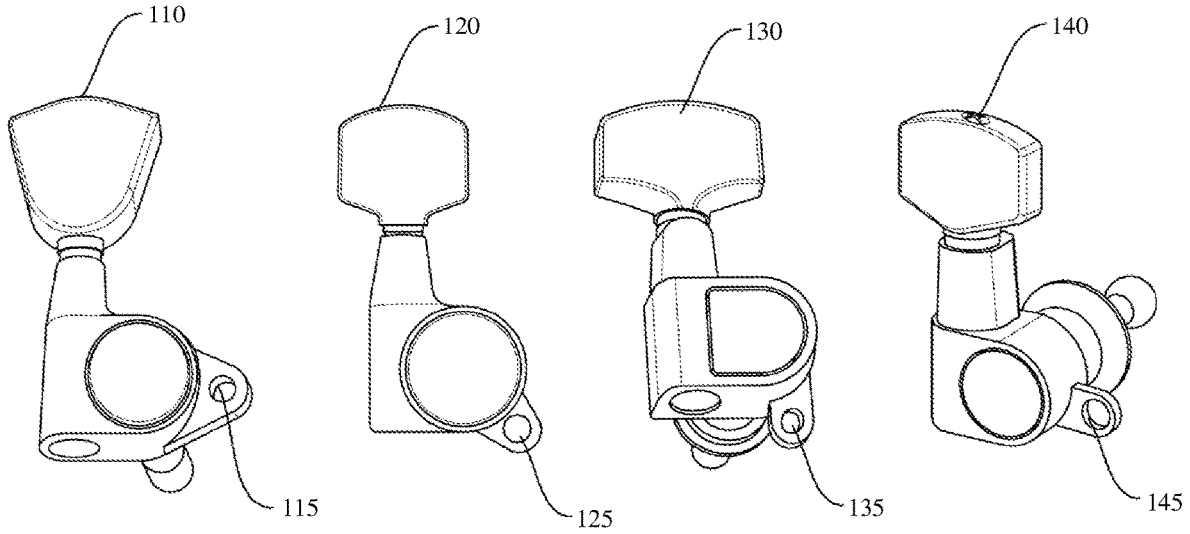
FIG. 1 Prior Art
FIG. 1 illustrates different machine heads with different mounting bases and/or different positioning for the mounting base screw holes.
Figure 2:
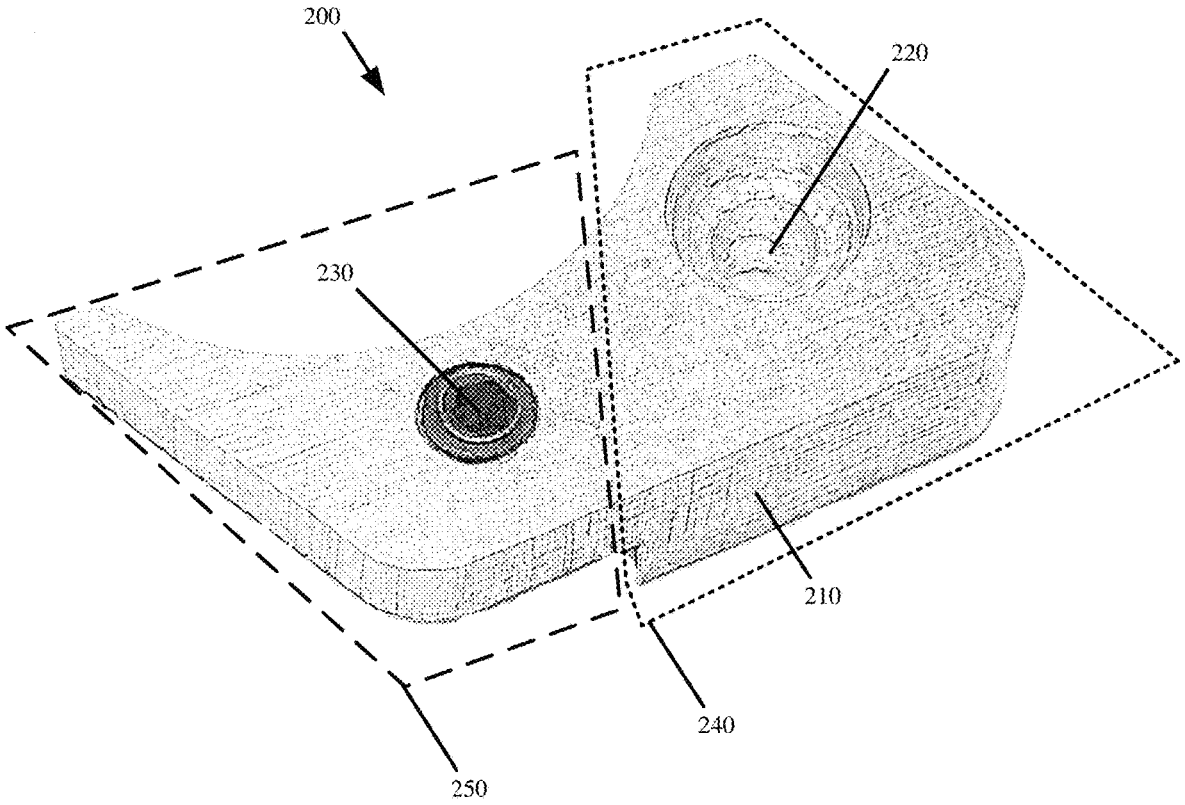
FIG. 2 presents a top view of an example machine head adapter in accordance with some embodiments presented herein.
Figure 3:
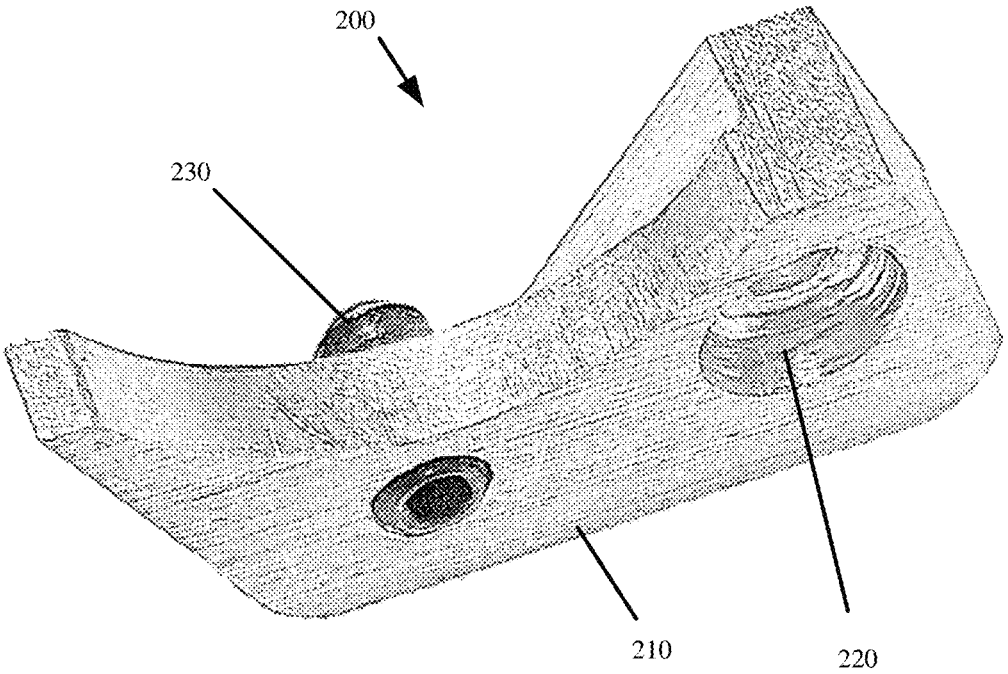
FIG. 3 presents a side perspective view of the example machine head adapter.
Figure 4:
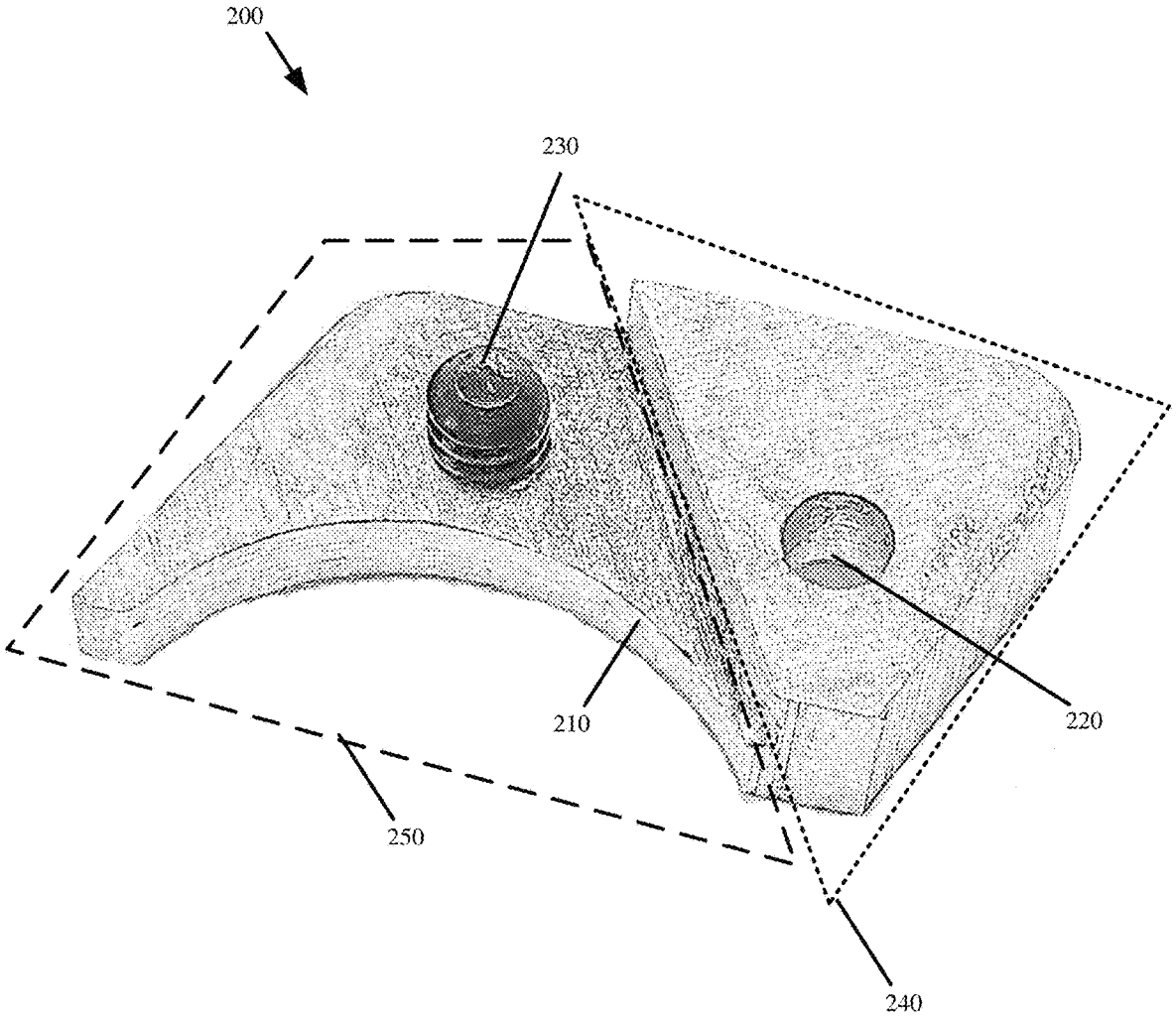
FIG. 4 presents a bottom or upside-down view of the example machine head adapter.
Figure 5:
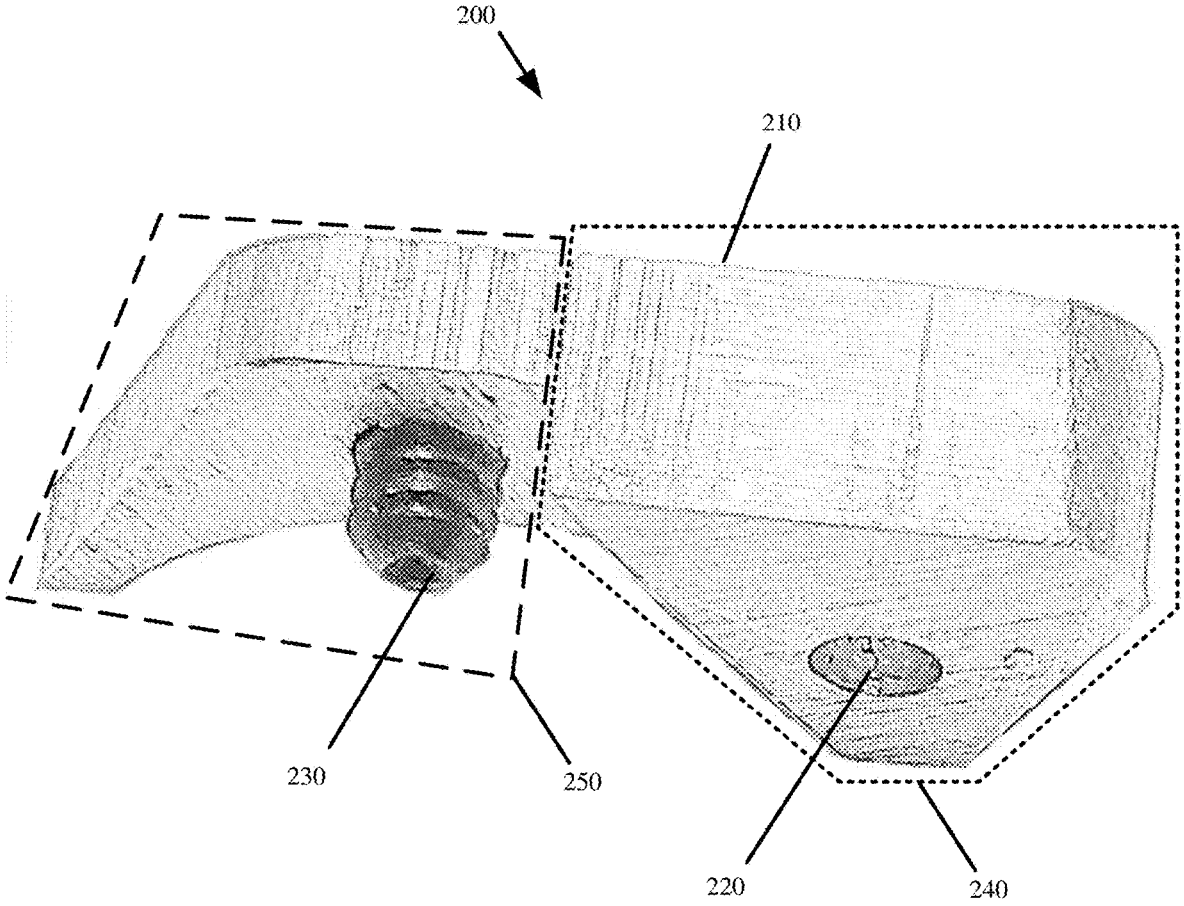
FIG. 5 presents a perspective view from a back side of the example machine head adapter.

FIG. 2 presents a top view of example machine head adapter 200 in accordance with some embodiments presented herein. FIG. 3 presents a side perspective view of machine head adapter 200 in accordance with some embodiments presented herein. FIG. 4 presents a bottom or upside-down view of machine head adapter 200 in accordance with some embodiments presented herein. FIG. 5 presents a perspective view from a back side of machine head adapter 200 in accordance with some embodiments presented herein.

Machine head adapter 200 may be an apparatus that includes support body 210, mounting point 220, and set screw 230. The size, shape, and dimensions of machine head adapter 200 illustrated in FIGS. 2-5 are provided as an example of one machine head adapter 200 for mounting one or more machine heads with a particular housing shape or style, a particular mounting base, and/or a particular positioning for one or more screw holes about the particular mounting base.

Body 210 may be formed from metal, plastic, wood, or another rigid material. Body 210 may include base section 240 and support extension 250.

In some embodiments, body 210 may be machined from a single solid block of metal, plastic, wood, or another rigid material, and base section 240 and support extension 250 may reference different parts of the single block of metal, plastic, wood, or another rigid material. In some embodiments, body 210 may be formed from joining (e.g., welding, gluing, etc.) base section 240 to support extension 250.

Base section 240 may be of a first thickness that is greater than a second thickness of support extension 250. For instance, FIGS. 4 and 5 illustrate the difference in thickness between base section 240 and support extension 250. As a result of this difference in thickness, the portion of body 210 that forms base section 240 may have an overall height or depth that is greater than the portion of body 210 that forms support extension 250.

In some embodiments, at least one side of base section 240 has a shape that matches or conforms to the shape of a replacement machine head mounting base. In some such embodiments, the lower part of base section 240, that is in the shape of the replacement machine head mounting base, provides an anchor that abuts the mounting base and provides a first retention point against the mounting base and/or replacement machine head that prevents movement of the mounting base and/or replacement machine head.

Base section 240 may include an opening that corresponds to mounting point 220. Mounting point 220 may provide a screw hole that is positioned and/or oriented to align with an existing mounting hole on the headstock or another part of the instrument. The size of mounting point 220 may correspond to the size of the screw originally used to secure the original machine head to the existing mounting hole. Mounting point 220 may receive a screw in order to secure machine head adapter 200 and a particular machine head held in place by machine head adapter 200 to the instrument, wherein the screw body fits in the opening of mounting point 220, and wherein the screw head or top cannot pass through mounting point 220.

Support extension 250 may extend laterally from base section 240. Specifically, support extension 250 may extend laterally from a top edge or upper part of base section 240 such that the bottom of support extension 250 is elevated relative to the instrument and/or the replacement tuning machine mounting base when base section 240 is placed atop the instrument.

Along the length of support extension 250 are one or more openings that retain one or more set screws 230. Each set screw 230 may extend downward from the elevated position of support extension 250, and the length of the downward extension may be adjusted by rotating set screw 230 in one of two directions. Set screw 230 may be positioned about support extension with a specific distance and offset position from mounting point 220 that correspond to the distance and offset position between an existing mounting hole on the instrument and the position of the screw hole about the mounting base of a machine head that is to be mounted using that existing mounting hole (e.g., when the machine head winding post is inserted into a bore hole that is located closest to or adjacent to the existing mounting hole). In other words, base section 240, support extension 250, and set screw 230 may combine to create a bridge between the existing mounting hole on the instrument and the screw hole in the mounting base of the machine head.

In some embodiments, set screw 230 may be replaced with, or may include, a fixed pin or protrusion that extends below support extension 250. In some such embodiments, set screw 230 may be machined into or affixed directly to the underside of support extension 250.

As shown in subsequent figures, support extension 250 may be elevated relative to the instrument and/or the bottom of base section 240 so that support extension 250 may slide over a portion of the machine head mounting base, and may position set screw 230 over and/or into a screw hole in the machine head mounting base.

The elevated position of support extension 250 may also be used to abut one side of support extension 250 directly against the machine head housing or winding post to prevent displacement or movement of the machine head once the machine head is mounted to the instrument using machine head adapter 200. As shown in FIGS. 2-5, support extension 250 may be curved and/or may include a concave indentation across the length of support extension 250. The curvature and/or shape of support extension 250 may be formed to match the curvature and/or form of one or more machine head housings. Specifically, support extension 250 may curve inward with a radius and length that aligns with and abuts directly to the machine head housing. In some embodiments, support extension 250 may encircle or border 120 degrees or more of the machine head housing. The surface contact that the matching shape of support extension 250 creates with the machine head housing may be used to support the machine head and/or prevent rotation, movement, or other displacement of the machine head.

The machine head adapters may be produced as complimentary pairs. A complimentary pair of machine head adapters may include one machine head adapter 200 and a mirrored or reflected variant of that machine head adapter 200. The complimentary pair may be provided for mounting machine heads on different sides of the instrument headstock.

Figure 6:
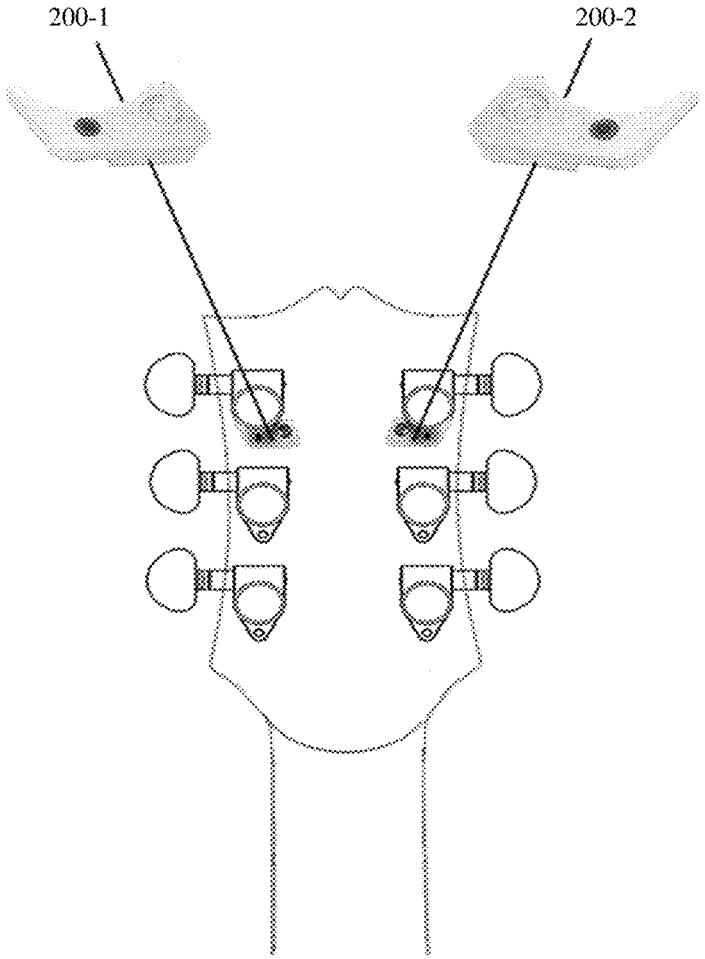
FIG. 6 illustrates an example of a complimentary pair of machine head adapters in accordance with some embodiments presented herein.

FIG. 6 illustrates an example of a complimentary pair of machine head adapters 200-1 and 200-2 in accordance with some embodiments presented herein. As shown, machine head adapter 200-1 may be used to secure a machine head to the left side of the guitar headstock (e.g., the treble side of a right-handed guitar headstock or the bass side of a left-handed guitar headstock), and machine head adapter 200-2 may be used to secure a machine head to the right side of the guitar headstock (e.g., the bass side of a right-handed guitar headstock or the treble side of a left-handed guitar headstock).

In some embodiments, machine head adapter 200 may include body 210 with different sizes, shapes, and/or dimensions, with more mounting points 220, with more set screws 230, and/or with different placements for the one or more mounting points 220 and/or set screws 230. The variations of machine head adapter 200 may be provided to support mounting of machine heads with different housing shapes or styles, different mounting bases, and/or different positioning for one or more mounting base screw holes to instruments (e.g., instrument headstocks) with different numbers of mounting holes and/or mounting hole positions.

Figure 7:
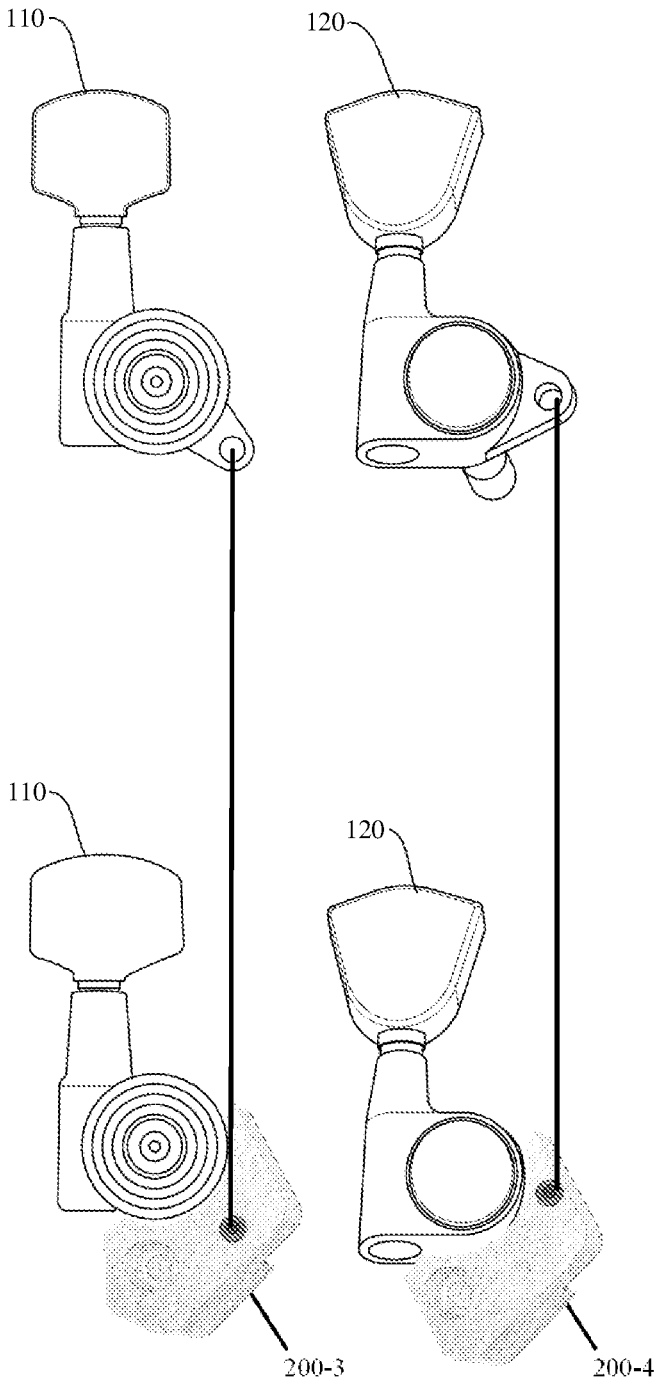
FIG. 7 illustrates the machine head adapter with different set screw positioning to accommodate mounting of machine heads with different mounting base configurations and/or mounting base hole positioning in accordance with some embodiments presented herein.
Figure 8:
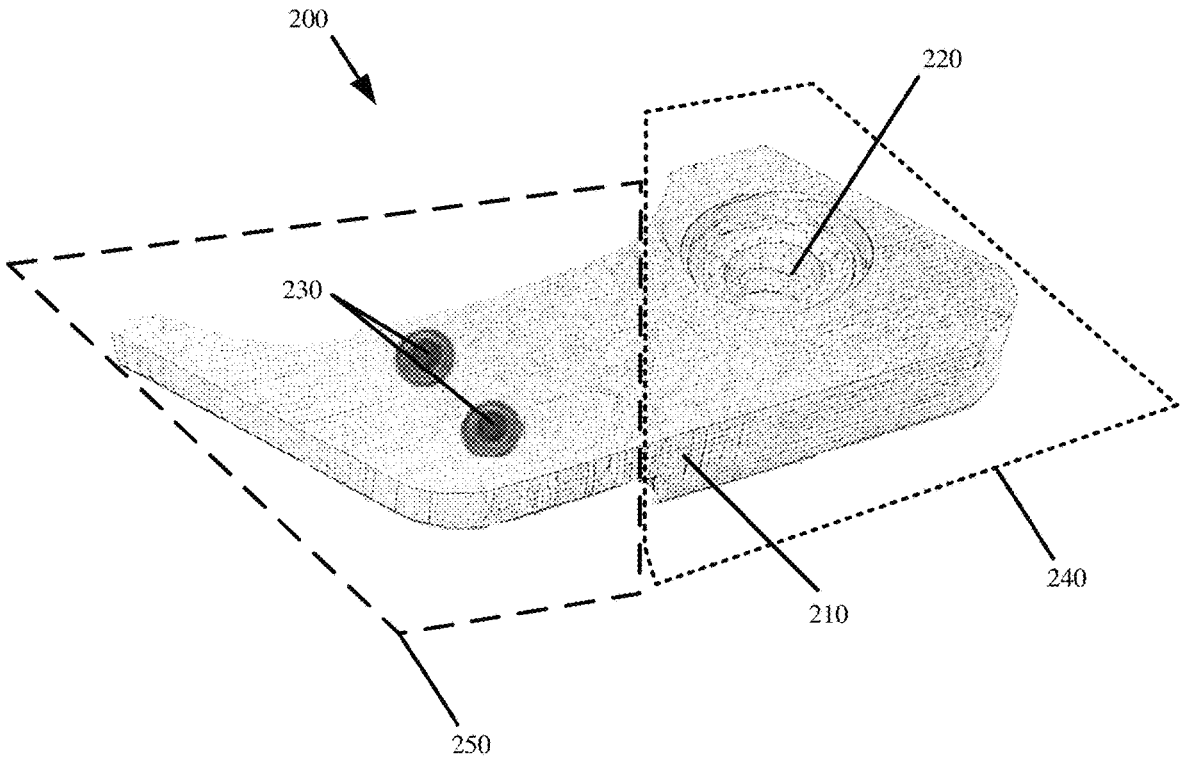
FIG. 8 an alternate embodiment of the machine head adapter in accordance with some embodiments presented herein.

FIG. 7 illustrates machine head adapter 200 with different set screw 230 positioning to accommodate mounting of machine heads with different mounting base configurations and/or screw hole positioning in accordance with some embodiments presented herein. In particular, first machine head adapter 200-3 may have a first position for set screw 230 that conforms to a first placement of the screw hole of machine head 110, and second machine head adapter 200-4 may have a different second position for set screw 230 that conforms to a second placement of the screw hole of machine head 120. Accordingly, first machine head adapter 200-3 with the first position for set screw 230 may be used to mount machine head 110 to an instrument with a particular mounting hole that is misaligned with the screw hole of machine head 110, and second machine head adapter 200-4 with the different second position for set screw 230 may be used to mount machine head 120 to the same instrument with the same particular mounting hole that is misaligned with the alternative positioning of the screw hole for machine head 120. FIG. 8 presents an alternate embodiment of machine head adapter 200 in which the length of support extension 250 is increased, the curvature of support extension 250 is decreased, and two set screws 230 are provided to conform to a shape and/or size of a particular machine head and to align the position of set screws 230 with the positions of two screw holes about the mounting base of that particular machine head.

In some embodiments, the position and/or placement of base section 240 may change relative to support extension 250. The position and/or placement of base section 240 may depend on the position of the instrument mounting holes relative to the instrument bore hole into which the machine head winding post is inserted. Similarly, in some embodiments, the position, placement, and/or number of mounting points 220 may change depending on the position of the instrument mounting holes relative to the instrument bore holes. In general, different machine head adapters 200 may be provided to mount one or more machine heads with different housing shapes and/or sizes, different mounting bases, and/or different mounting screw patterns (e.g., screw hole patterns) to instruments with different numbers and/or placements of mounting holes relative to a bore hole into which the machine head is inserted.

Figure 9:
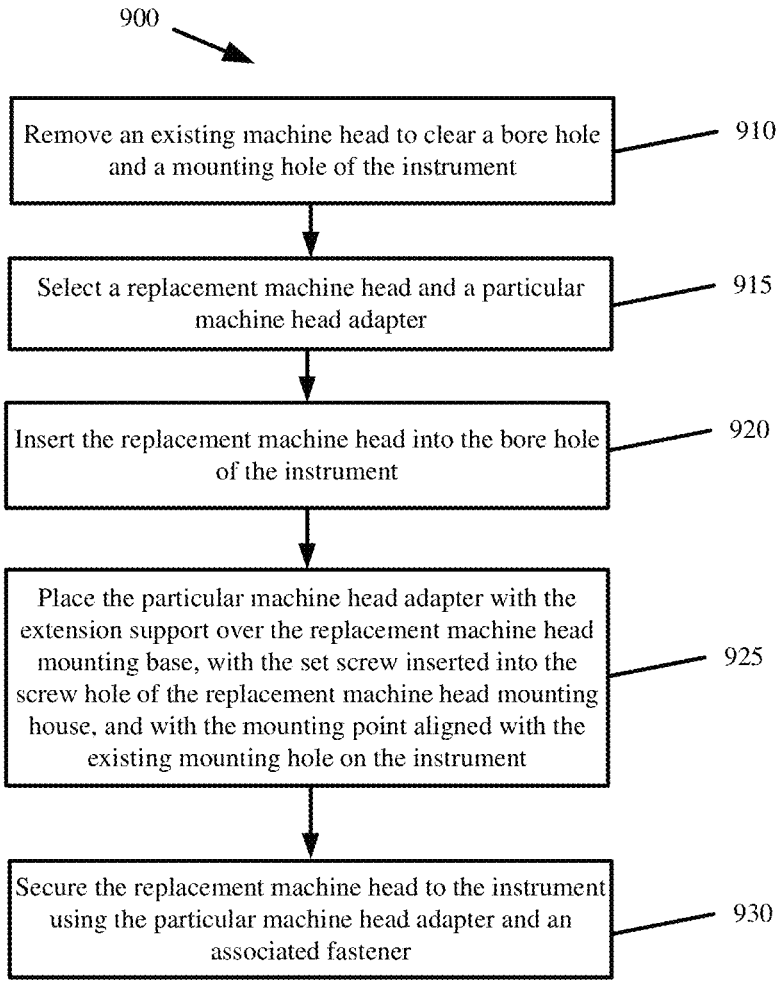
FIG. 9 presents a process for mounting a machine head with screw holes that are misaligned with mounting holes of an instrument using the machine head adapter in accordance with some embodiments presented herein.

FIG. 9 presents a process 900 for mounting a machine head with screw holes that are misaligned with mounting holes of an instrument using machine head adapter 200 in accordance with some embodiments presented herein. Process 900 may include removing (at 910) an existing machine head from the instrument to clear the bore hole, that was retaining the existing machine head, and the mounting hole, that was used to secure the existing machine head to the instrument. Removing (at 910) the existing machine head may involve unscrewing the one or more screws that secure the existing machine head to the instrument.

Process 900 may include selecting (at 915) a replacement machine head and a particular machine head adapter from a plurality of machine head adapters based on the position the replacement machine head screw hole(s) relative to the position of the existing machine head screw hole or the position of the cleared mounting hole relative to the bore hole. Selecting (at 915) the particular machine head adapter may include selecting machine head adapter 200 with support extension 250 that has a form matching the form (e.g., shape and/or size) of the replacement machine head housing or winding post, and with set screw 230 and mounting point 220 positioned according to the distance and offset between the replacement machine head screw hole and the existing mounting hole of the instrument.

Process 900 may include inserting (at 920) the replacement machine head into the bore hole of the instrument that was cleared upon removing (at 910) the previous machine head. Inserting (at 920) the replacement machine head into the bore hole may include pushing the replacement machine head into the bore hole until the mounting base of the replacement machine head is flush against the instrument. At this stage, the one or more screw holes of the replacement machine head will be misaligned with the existing mounting hole(s) of the instrument.

Process 900 may include placing (at 925) the particular machine head adapter with support extension 250 over the replacement machine head mounting base, with set screw 230 of the particular machine head adapter inserted into the screw hole of the replacement machine head mounting base, and with mounting point 220 of the particular machine head adapter aligned with the existing mounting hole on the instrument. In some embodiments, a user may adjust the length of set screw 230 by rotating set screw 230. The user may adjust the length of set screw 230 so that set screw 230 extends through the replacement machine head screw hole until contact is made with the instrument surface.

Process 900 may further include securing (at 930) the replacement machine head to the instrument using the particular machine head adapter and one or more associated fasteners. Securing (at 930) the structures together may include inserting a screw or another fastener into mounting point 220 of the particular machine head adapter, and screwing the screw or another fastener into the existing mounting hole of the instrument, thereby coupling the particular machine head adapter to the instrument with set screw 230 and support extension 250 abutting and retaining the replacement machine head position.

Figure 10:
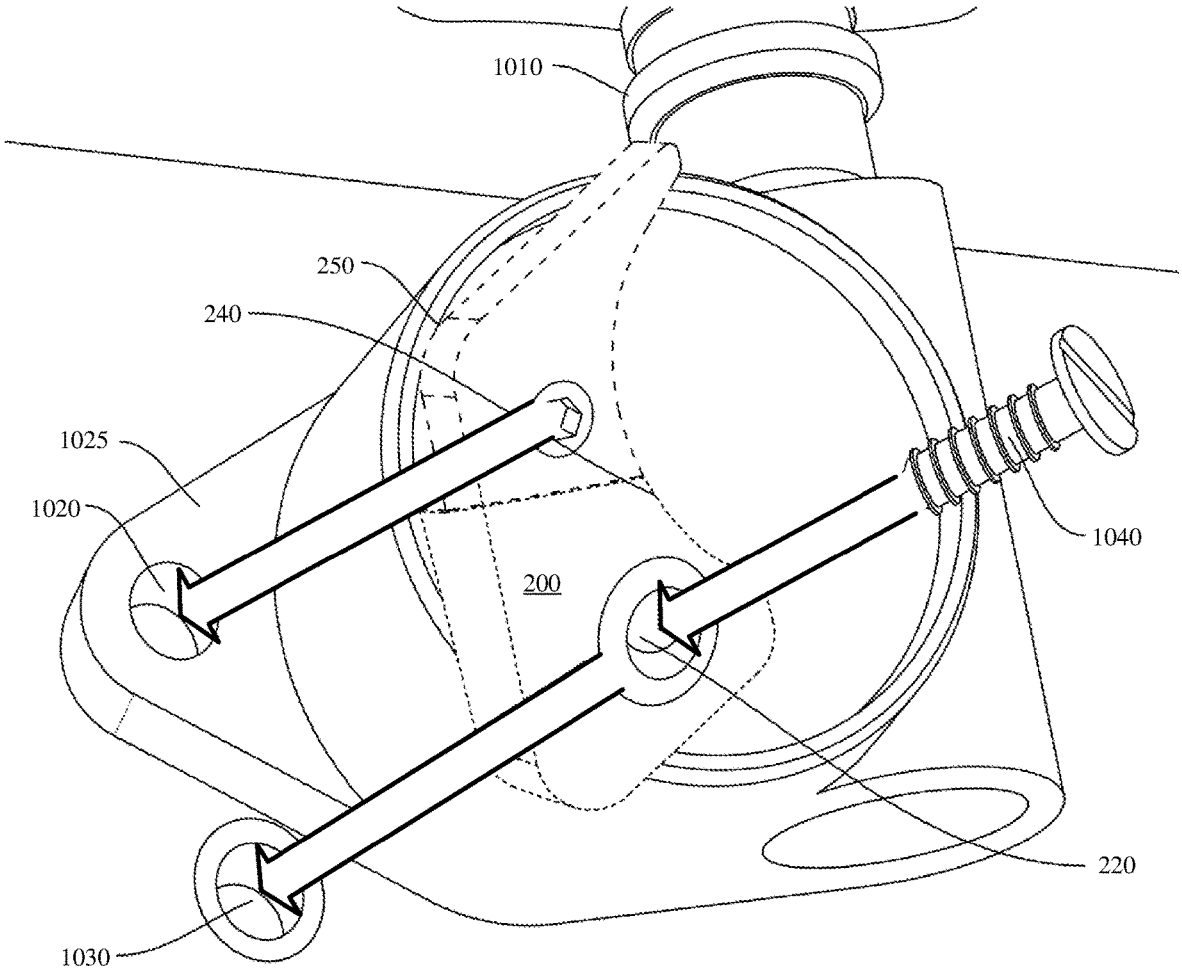
FIG. 10 illustrates an example of the machine head adapter mounting a replacement machine head to an instrument in accordance with some embodiments presented herein.

FIG. 10 illustrates an example of machine head adapter 200 mounting replacement machine head 1010 to an instrument in accordance with some embodiments presented herein. As shown in FIG. 10, replacement machine head 1010 may have screw hole 1020 in mounting base 1025 that is misaligned with existing mounting hole 1030 of the instrument.

Elevated support extension 250 of machine head adapter 200 may be placed over mounting base 1025 of replacement machine head 1010 such that the curved surface of support extension 250 is flush against and abuts the housing of replacement machine head 1010, set screw 230 is inset into screw hole 1020, and base section 240 is flush against and directly abuts mounting base 1025 while also resting flush against the instrument surface (e.g., the headstock of a guitar). Replacement machine head 1010 and machine head adapter 200 may be mounted to the instrument by screwing screw 1040 through mounting point 220 into existing mounting hole 1030, and/or by adjusting the length of set screw 230 to pass through screw hole 1020 and/or contact the instrument surface.

Once machine head adapter 200 is secured to the instrument by driving screw 1040 through mounting point 220 and into existing mounting hole 1030, machine head adapter 200 may provide at least three points of contact for retaining position of machine head 1010. The three points of contact may include a first point of contact based on the curvature and length of support extension 250 directly abutting and engaging machine head 1010 housing as a result of the curvature and length of support extension 250 matching the shape and diameter of machine head 1010 housing. The three points of contact may include a second point of contact based on the elevated and lateral extension of support extension 250 extending over mounting base 1025 with set screw 230 extending downwards from support extension 250 into aligned screw hole 1020 in mounting base 1025, and a third point of contact based on the lower part of base section 240, that is below support extension 250, directly abutting the mounting base 1025 by matching the shape of mounting base 1025. These three points of contact between machine head adapter 200 and replacement machine head 1010 (e.g., support extension 250 against the body or housing of replacement machine head 1010, set screw 230 within screw hole 1020, and base section 240 against mounting base 1025) will firmly retain a position of replacement machine head 1010 against the instrument, and will prevent displacement of replacement machine head 1010 when force is exerted to turn the adjustment knob, or when the instrument is played.

Figure 11:
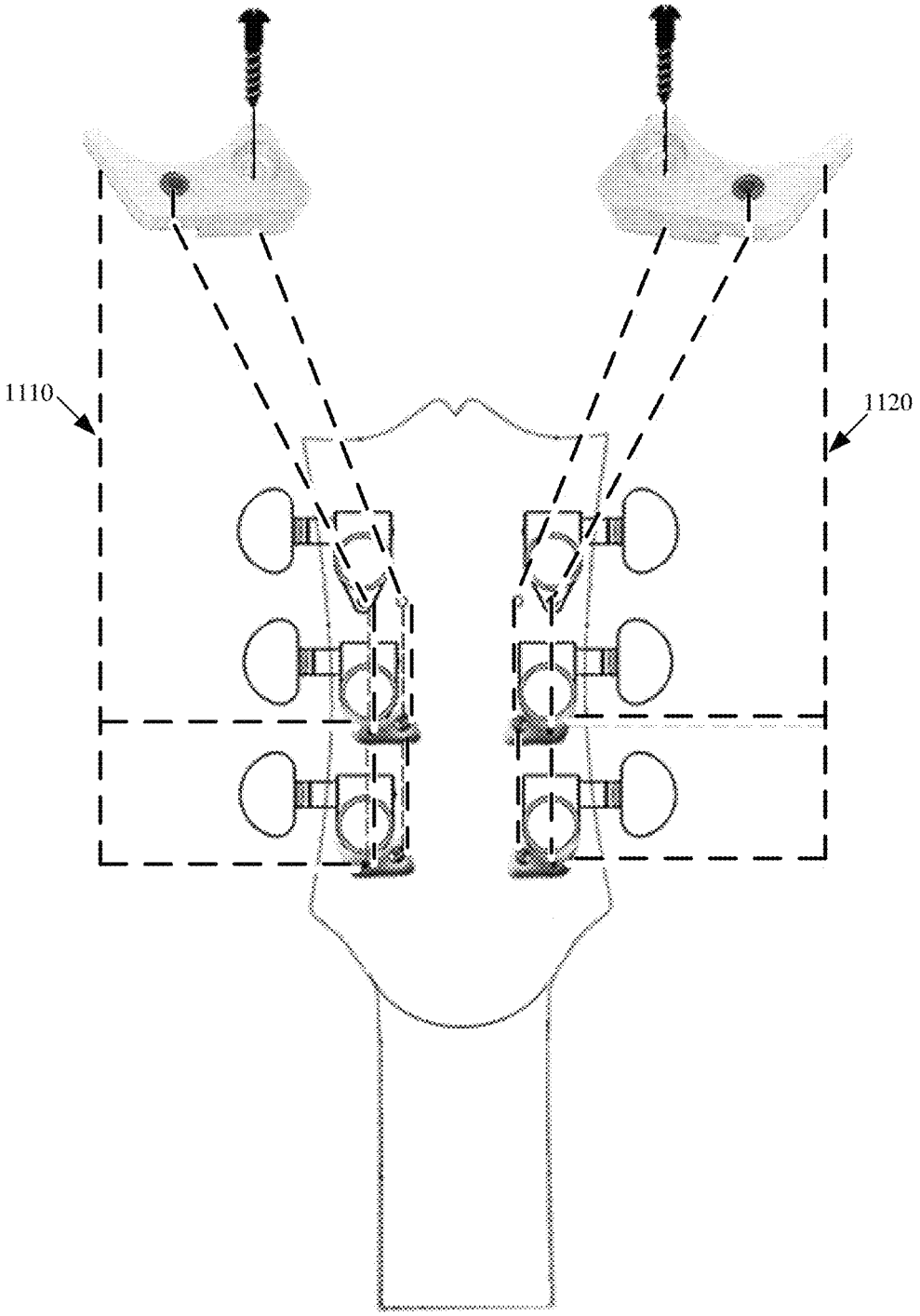
FIG. 11 illustrates an example of using different sets of machine head adapters to secure a set of machine heads to an instrument in accordance with some embodiments presented here.

FIG. 11 illustrates an example of using different sets of machine head adapters to secure a set of machine heads to an instrument in accordance with some embodiments presented here. First set of machine head adapters 1110 are provided and used to secure the leftward facing machine heads, and complimentary second set of machine head adapters 1120 are provided and used to secure the rightward facing machine heads.

The foregoing description of implementations provides illustration and description, but is not intended to be exhaustive or to limit the possible implementations to the precise form disclosed. Modifications and variations are possible in light of the above disclosure or may be acquired from practice of the implementations. Moreover, even though particular combinations of features are recited in the claims and/or disclosed in the specification, these combinations are not intended to limit the disclosure of the possible implementations. In fact, many of these features may be combined in ways not specifically recited in the claims and/or disclosed in the specification. Although each dependent claim listed below may directly depend on only one other claim, the disclosure of the possible implementations includes each dependent claim in combination with every other claim in the claim set.

Some implementations described herein may be described in conjunction with thresholds. The term "greater than" (or similar terms), as used herein to describe a relationship of a value to a threshold, may be used interchangeably with the term "greater than or equal to" (or similar terms). Similarly, the term "less than" (or similar terms), as used herein to describe a relationship of a value to a threshold, may be used interchangeably with the term "less than or al to" (or similar terms). As used herein, "exceeding" a threshold (or similar terms) may be used interchangeably with "being greater than a threshold," "being greater than or equal to a threshold," "being less than a threshold," "being less than or equal to a threshold," or other similar terms, depending on the context in which the threshold is used.

No element, act, or instruction used in the present application should be construed as critical or essential unless explicitly described as such. An instance of the use of the term "and," as used herein, does not necessarily preclude the interpretation that the phrase "and/or" was intended in that instance. Similarly, an instance of the use of the term "or," as used herein, does not necessarily preclude the interpretation that the phrase "and/or" was intended in that instance. Also, as used herein, the article "a" is intended to include one or more items, and may be used interchangeably with the phrase "one or more." Where only one item is intended, the terms "one," "single," "only," or similar language is used. Further, the phrase "based on" is intended to mean "based, at least in part, on" unless explicitly stated otherwise.

What is claimed is:

1. An apparatus comprising:

a solid rigid body comprising:

a base section of a first thickness;

a mounting point extending the first thickness through the base section, the mounting point providing an opening with which to secure the apparatus to an instrument mounting hole;

a support extension of a second thickness that is less than the first thickness, the support extension extending laterally from an upper part of the base section with a particular curvature and a particular length, wherein a bottom of the support extension is elevated over a bottom of the base section by a difference between the first thickness and the second thickness;

a set screw positioned about the particular length of the support extension, the set screw adjustably extending below the bottom of the support extension to the bottom of the base section;

a screw having a size commensurate with the opening of the mounting point.

2. The apparatus of claim 1, wherein the particular curvature and the particular length of the support extension matches a curvature and a diameter of a machine head that is mounted using the apparatus.

3. The apparatus of claim 1, wherein the apparatus creates a first point of contact that retains a position of a machine head, that is mounted using the apparatus, based on the particular curvature and the particular length of the support extension directly abutting and engaging the machine head by conforming to a shape and size of the machine head.

4. The apparatus of claim 3, wherein the apparatus creates a second point of contact that retains the position of the machine head based on the support extension extending laterally over a mounting base of the machine head and the set screw extending downward from the support extension into a screw hole of the mounting base.

5. The apparatus of claim 4, wherein the apparatus creates a third point of contact that retains the position of the machine head based on a lower part of the base section, that extends below the bottom of the support extension by the difference between the first thickness and the second thickness, abutting the mounting base of the machine head.

6. The apparatus of claim 1, wherein the particular curvature and the particular length of the support extension provide a lateral first retention point for machine head retention;

wherein the set screw adjustably extending below the bottom of the support extension to the bottom of the base section provides a vertical second retention point for the machine head retention; and wherein a lower part of the base section, that extends below the bottom of the support extension by the difference between the first thickness and the second thickness, provides a lateral third retention point for the machine head retention.

7. The apparatus of claim 1, wherein a distance and offset between the mounting point and the set screw equal a distance and offset that prevents a machine head from mounting to an existing instrument mounting hole.

8. The apparatus of claim 1, wherein the apparatus creates a bridge between a first retention point of a first object at a position of the mounting point, and a second retention point of a second object at a position of the set screw.

9. An adapter for mounting a machine head to an instrument by correcting misalignment between a first retention point of the machine head and a second retention point of the instrument, the adapter comprising:

a screw;

a base section with a mounting point, wherein the mounting point is aligned with the second retention point, wherein the mounting point is used to attach the adapter to the second retention point using the screw, and wherein a bottom part of the base section provides a lateral first contact point preventing machine head displacement;

an elevated extension protruding laterally with an indentation from a top part of the base section over the bottom part, the elevated extension providing a lateral second contact point preventing the machine head displacement; and an adjustable extension extending downward from the elevated extension at a position that is aligned with the first retention point, the adjustable extension providing a vertical third contact point preventing the machine head displacement.

10. The adapter of claim 9, wherein the base section rests flush against a surface of the instrument, and wherein the elevated extension is separated from the surface by a height equal to a difference between the top part and the bottom part of the base section.

11. The adapter of claim 9, wherein the indentation of the elevated extension comprises a shape that matches a shape of the machine head.

12. The adapter of claim 9, wherein the base section and the elevated extension are a single continuous rigid material that spans a distance and offset between the first retention point of the machine head and the second retention point of the instrument.

13. The adapter of claim 9, wherein the bottom part of the base section engages a mounting base of the machine head to create the first contact point, and wherein the elevated extension engages a body of the machine head to create the second contact point.

14. A system comprising:

an instrument comprising a headstock with a bore hole and at least one existing mounting hole positioned relative to the bore hole;

a machine head inset within the bore hole, the machine head comprising a mounting base and a screw hole in the mounting base that is misaligned with the existing mounting hole of the instrument by a particular distance; and a machine head adapter placed over the existing mounting hole and the mounting base of the machine head, wherein the machine head adapter comprises:

a screw; and a solid rigid body with a mounting point at a first position corresponding to a position of the existing mounting hole and with a set screw extending downward from the solid rigid body the particular distance away from the first position at a second position corresponding to a position of the screw hole in the mounting base, and wherein the machine head adapter mounts the machine head to the instrument by screwing the screw into the existing mounting hole via the mounting point, by abutting the mounting base with a bottom of the solid rigid body, by abutting the machine head with an extension of the solid rigid body that is elevated over the mounting base and that conforms to a shape of the machine head, and by inserting the set screw into the screw hole in the mounting base.

* * * * *